US009610766B2

(12) United States Patent
Makita et al.

(10) Patent No.: US 9,610,766 B2
(45) Date of Patent: Apr. 4, 2017

(54) LIQUID DISCHARGE APPARATUS AND METHOD OF CONTROLLING THE SAME

(71) Applicant: SEIKO EPSON CORPORATION, Tokyo (JP)

(72) Inventors: Shushi Makita, Shiojiri (JP); Noriaki Yamashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/192,834

(22) Filed: Jun. 24, 2016

(65) Prior Publication Data

US 2017/0001434 A1 Jan. 5, 2017

(30) Foreign Application Priority Data

Jul. 2, 2015 (JP) ..... 2015-133269

(51) Int. Cl.
*B41J 2/045* (2006.01)
*B41J 2/175* (2006.01)

(52) U.S. Cl.
CPC ..... *B41J 2/04508* (2013.01); *B41J 2/04586* (2013.01); *B41J 2/17563* (2013.01)

(58) Field of Classification Search
CPC B41J 2/04581; B41J 2/04588; B41J 2/04508; B41J 2/04586; B41J 2/17563; B41J 2/0451; B41J 2/1752; B41J 2/04541; B41J 2002/14354
See application file for complete search history.

(56) References Cited

U.S. PATENT DOCUMENTS 6,695,437 B2 * 2/2004 Nakamura ..... B41J 2/04541 347/68
8,132,882 B2 * 3/2012 Suzuki ..... B41J 2/04563 347/14

FOREIGN PATENT DOCUMENTS

JP 05-116337 5/1993
JP 2006-076136 3/2006
JP 2011-167873 9/2011

* cited by examiner

*Primary Examiner* — Thinh H Nguyen
(74) *Attorney, Agent, or Firm* — Workman Nydegger

(57) ABSTRACT

A liquid discharge apparatus includes a filter configured to filter liquid to be discharged from a nozzle, a vibration detection mechanism configured to detect vibration of ink in an ink flow path generated by the driving of a piezoelectric element as an actuator; and a calculation circuit configured to obtain a detection value obtained by the vibration detection mechanism and perform calculation by using the detection value, wherein the vibration detection mechanism detects vibration of n ($1<n\leq m$) nozzles out of m nozzles included in the recording head, and the calculation circuit determines a state of the filter on the basis of a result of the calculation performed by using the detection value obtained by the vibration detection mechanism.

7 Claims, 5 Drawing Sheets

LIQUID DISCHARGE APPARATUS AND METHOD OF CONTROLLING THE SAME

BACKGROUND

1. Technical Field

The present invention relates to a liquid discharge apparatus, such as an ink jet recording apparatus, and the like and a method of controlling a liquid discharge apparatus. In particular, the invention relates to a liquid discharge apparatus provided with a filter that filters liquid to be discharged from a nozzle of a liquid discharge head, and a method of controlling a liquid discharge apparatus.

2. Related Art

A liquid discharge apparatus is an apparatus that includes a liquid discharge head and that discharges (ejects) various kinds of liquid from the liquid discharge head. As the liquid discharge apparatus, there are image recording apparatuses, for example an ink jet printer, an ink jet plotter, and the like. However, the liquid discharge apparatus has recently been applied to various manufacturing apparatuses by taking advantage of the feature of enabling a tiny droplet to precisely impact on a predetermined position. For example, the liquid discharge apparatus is applied to a display manufacturing apparatus for manufacturing a color filter of a liquid crystal display, and the like, to an electrode forming apparatus for forming an electrode of an organic electro luminescence (EL) display, a field emission display (FED), and the like, and to a chip manufacturing apparatus for manufacturing a biochip (biochemical element). The recording head for the image recording apparatus discharges liquid ink, and the color material discharge head for the display manufacturing apparatus discharges each color material solution of R (Red), G (Green), and B (Blue). Also, the electrode material discharge head for the electrode forming apparatus discharges a liquid electrode material, and the bio-organic material discharge head for the chip manufacturing apparatus discharges a bio-organic material solution.

Here, in the above-described liquid discharge apparatus, a filter for filtering liquid is generally provided in the flow path from a liquid storage member storing liquid to a nozzle of the liquid discharge head. The filter removes foreign substances, such as bubbles, and the like in the liquid. Thereby, the occurrence of hindrance to liquid discharge, which is caused by foreign substances, and the like that clog the flow path of the liquid discharge head, is suppressed. However, if the filter is clogged by the accumulation of foreign substances, and the like, the liquid is not smoothly supplied to the nozzle, and thus liquid discharge at the nozzle might be adversely affected. Accordingly, various proposals have been made regarding a configuration for detecting clogging of the filter (for example, refer to JP-A-5-116337, JP-A-2011-167873, and JP-A-2006-076136). In the configuration disclosed in JP-A-05-116337, clogging of the filter is detected on the basis of the pressure difference between the respective pressure sensors of the upstream side and the downstream side on the supply route of the liquid. Also, in the configuration disclosed in JP-A-2011-167873, clogging of the filter is detected on the basis of the drive state of the pump in the circulation system path of the liquid. JP-A-2006-076136 discloses the configuration in which a flow path in which a filter is disposed is provided with a bypass flow path that bypasses the filter, and clogging of the filter is detected on the basis of detection of a liquid flow in the bypass flow path caused by the clogging of the filter.

However, in these configurations of the related art, it has been necessary to additionally provide a special part or to employ a specific structure in order to detect clogging of the filter.

SUMMARY

An advantage of some aspects of the invention is that a liquid discharge apparatus capable of determining a filter state without providing a special part, a specific structure, or the like, and a method of controlling a liquid discharge apparatus are provided.

Mechanism 1

According to an aspect of the invention, there is provided a liquid discharge apparatus. The liquid discharge apparatus includes: a liquid discharge head including a plurality of nozzles configured to discharge liquid, liquid flow paths communicating individually with respective nozzles, and actuators configured to cause pressure vibration to be generated in liquid in the respective liquid flow paths, the liquid discharge head being configured to discharge liquid from corresponding nozzles by driving the actuators; a filter configured to filter the liquid; a vibration detection mechanism configured to detect vibration of the liquid generated by the driving of the actuators in the liquid flow paths; and a calculation circuit configured to obtain a detection value obtained by the vibration detection mechanism and perform calculation by using the detection value. In the liquid discharge apparatus, the vibration detection mechanism detects vibration of n ($1<n\leq m$) nozzles out of m nozzles included in the liquid discharge head, and the calculation circuit determines a state of the filter on the basis of a result of the calculation performed by using the detection value obtained by the vibration detection mechanism.

With the configuration of the mechanism 1, it is possible to determine the state of the filter (the degree of clogging) using a detection value of the vibration detection mechanism without providing a special part or a specific structure in order to detect the filter state.

Mechanism 2

In the above configuration of mechanism 1, it is desirable to employ a configuration in which the calculation circuit determines the state of the filter by comparing the result of the calculation and a predetermined threshold value.

With the configuration of the mechanism 2, a filter state is determined by comparing the result of the calculation and a predetermined threshold value, and thus it is possible to promptly determine the filter state.

Mechanism 3

In the above configuration of mechanism 2, if the result of the calculation is higher than the threshold value, it is desirable that the calculation circuit corrects a drive pulse driving the actuator.

With the configuration of the mechanism 3, if the result of the calculation is higher than the threshold value, the drive pulse is corrected, and thus even if the characteristic of the ink discharge is influenced by the clogging of the filter, it becomes possible to have the amount and the discharging speed of a droplet discharged from the nozzle that are close to design goals.

Mechanism 4

In the above configuration of mechanism 3, if the result of the calculation is higher than a first threshold value and lower than or equal to a second threshold value higher than the first threshold value, the control circuit may correct the drive pulse.

With the configuration of the mechanism 4, if the result of the calculation is higher than a first threshold value and lower than or equal to a second threshold value, the drive pulse is corrected. Thus it is possible to continuously use the filter until the state of requiring filter replacement without replacing the filter while suppressing the impact on the discharge characteristic.

Mechanism 5

In the above configuration of mechanism 4, if the result of the calculation is higher than the second threshold value, the control circuit desirably determines that the filter is in a state requiring maintenance.

With the configuration of the mechanism 5, if the result of the calculation is higher than the second threshold value, the filter is determined to be in the state of requiring filter maintenance. Thus it becomes possible to suitably handle the situation, for example to prompt a user to carry out maintenance, such as filter replacement or cleaning.

Mechanism 6

In any one of the above configurations of mechanisms 1 to 5, if the detection value of a part of the nozzles out of the n nozzles to be detected is higher than the detection values of the remaining nozzles, the control circuit desirably determines that a discharge failure has occurred due to a factor other than abnormality of the corresponding filter.

With the configuration of the mechanism 6, if a discharge failure has occurred due to a factor other than clogging of the filter, it is possible to perform suitable processing, such as recovery processing, for example so-called flushing processing of the nozzle, or the like in response to this.

Mechanism 7

According to another aspect of the invention, there is provided a method of controlling a liquid discharge apparatus. The liquid discharge apparatus includes a liquid discharge head including a plurality of nozzles configured to discharge liquid, liquid flow paths communicating individually with respective nozzles, and actuators configured to cause pressure vibration to be generated in liquid in the respective liquid flow paths, the liquid discharge head being configured to discharge liquid from corresponding nozzles by driving the actuators, a filter configured to filter the liquid, a vibration detection mechanism configured to detect vibration of the liquid generated by the driving of the actuators in the liquid flow paths, and a calculation circuit configured to obtain a detection value obtained by the vibration detection mechanism and perform calculation by using the detection value. The method includes: detecting vibration, by the vibration detection mechanism, of n ($1<n\leq m$) nozzles out of m nozzles included in the liquid discharge head; and determining a state of the filter on the basis of a result of the calculation performed by using the detection value obtained by the vibration detection mechanism.

BRIEF DESCRIPTION OF THE DRAWINGS

The invention will be described with reference to the accompanying drawings, wherein like numbers reference like elements.

DESCRIPTION OF EXEMPLARY EMBODIMENTS

In the following, a description will be given of embodiments of the invention with reference to the accompanying drawings. In this regard, in the embodiments described below, various limitations are imposed as preferred specific examples of the invention. However, in the following description, the scope of the invention is not limited to these embodiments unless a specific description of a limitation of the invention is given.

Figure 1:
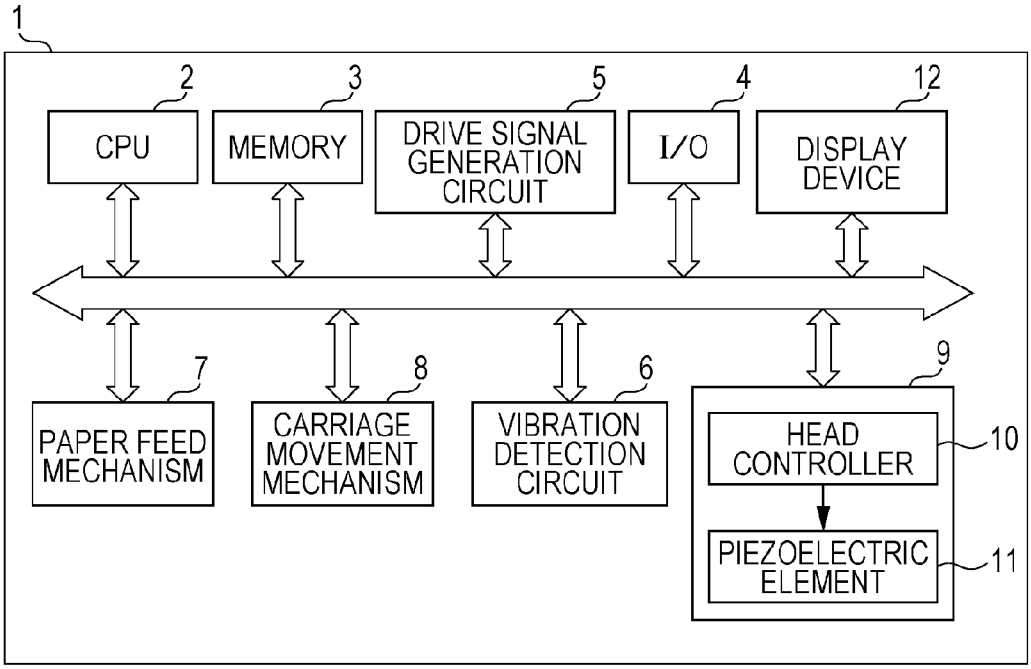
FIG. 1 is a block diagram illustrating an electrical configuration of a printer.
Figure 2:
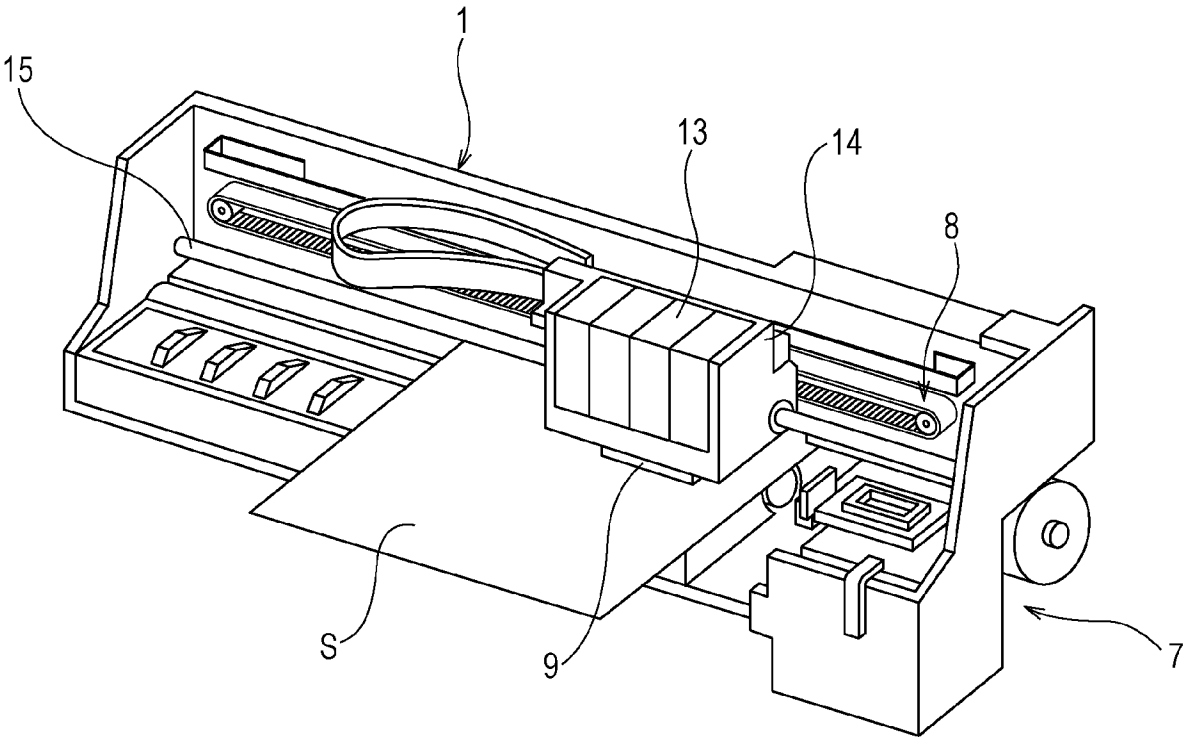
FIG. 2 is a perspective view illustrating an internal configuration of the printer.

FIG. 1 is a block diagram illustrating an electrical configuration of a printer 1 according to the invention. The printer 1 in the invention includes a CPU 2 (corresponds to the calculation circuit in the invention), a memory 3, an input and output interface 4, a drive signal generation circuit 5, a paper feed mechanism 7, a carriage movement mechanism 8, a vibration detection circuit 6, a display device 12, a recording head 9, and the like. The vibration detection circuit 6 is configured to output a counter electromotive force signal of a piezoelectric element 11, which is based on a pressure vibration (residual vibration) that arises in the ink in a pressure chamber when the piezoelectric element 11 is driven by a drive pulse Pd (refer to FIG. 4), to the CPU 2 as a detection signal. The CPU 2 detects vibration of the ink in the pressure chamber using the piezoelectric element 11 as a vibration sensor. That is, the piezoelectric element 11 and the vibration detection circuit 6 function as the vibration detection mechanism in the invention. In this regard, a detailed description will be given later of a vibration detection process by the vibration detection circuit 6.

The input and output interface 4 performs transmission and reception of various kinds of data, such as receiving a request for recording processing, or the like, or data related to printing from a host computer, which is a kind of host apparatus, or outputting the state information of the printer 1 to the host computer. The CPU 2 is a processor for performing control of the entire printer. The memory 3 is an element that stores programs of the CPU 2, and data used for various kinds of control, and includes a ROM, a RAM, and an NVRAM (nonvolatile storage element). The CPU 2 controls each section in accordance with the program stored in the memory 3. Also, the CPU 2 in the present embodiment transmits printing data from the host apparatus to a head controller 10 of the recording head 9. The drive signal generation circuit 5 (drive pulse generation circuit) generates an analog signal on the basis of the waveform data on the waveform of the drive signal, and amplifies the signal to generate a drive signal including a drive pulse Pd illustrated in FIG. 4. The head controller 10 performs control for selectively applying a drive pulse Pd of the drive signal generated by the drive signal generation circuit 5 to each piezoelectric element 11. The display device 12 includes a liquid crystal display device built in a housing of the printer 1, and displays for example, various kinds of setting information on the printing, a warning for prompting replacement of a filter 22 as described later, or the like.

In the printer 1 in the present embodiment, the recording head 9 is attached to the base side of the carriage 14 on which ink cartridges 13 are mounted. The carriage 14 is configured to move reciprocatively along a guide rod 15 by a carriage movement mechanism 8. That is, in the printer 1, the paper feed mechanism 7 transports a recording medium S, such as recording paper, or the like, and at the same time, while the recording head 9 is relatively moved in the width direction (main scanning direction) of the recording medium S, ink is discharged from a nozzle 17 (refer to FIG. 3) of the recording head 9 so that the ink impacts on the recording medium S in order to record an image, or the like. In this regard, it is possible to employ a configuration in which an ink cartridge 13 is disposed on the main body of the printer, and ink of the ink cartridge 13 is sent to the recording head 9 through a supply tube.

Figure 3:
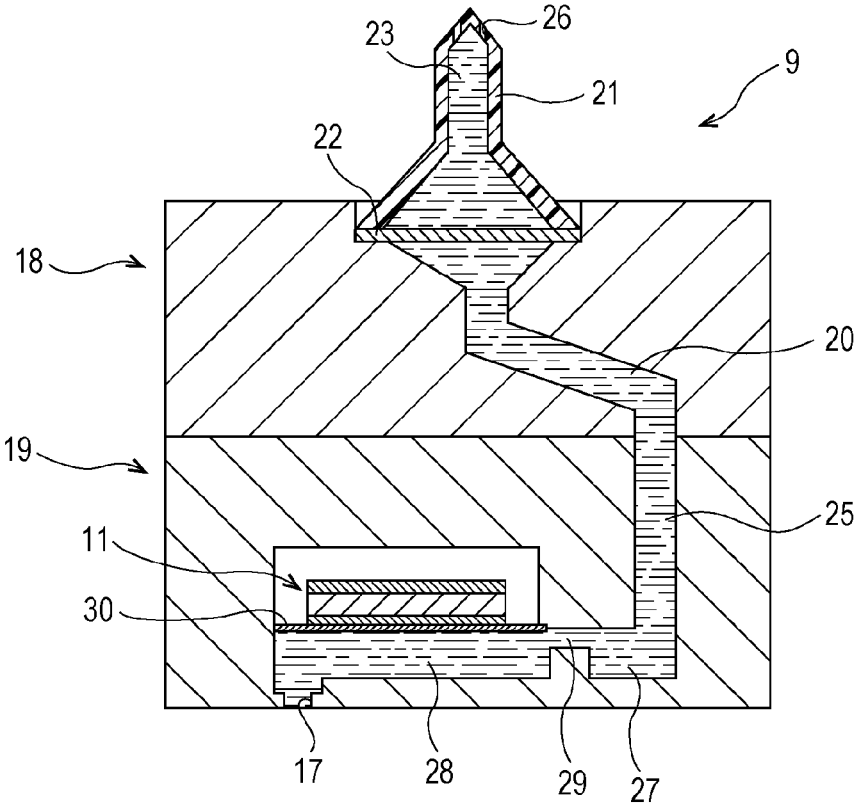
FIG. 3 is a schematic sectional view illustrating a configuration of a recording head.

FIG. 3 is a schematic sectional view of the recording head 9. The recording head 9 in the present embodiment includes an ink introducing unit 18 and a head main body 19. An ink introduction needle 21 is attached on the upper surface of the ink introducing unit 18 with the filter 22 interposed therebetween. The ink introduction needle 21 is configured to be inserted into the inside of the ink cartridge 13 mounted on the carriage 14. Also, an ink introduction path 20 is formed in the inside of the ink introducing unit 18. The upstream side of the ink introduction path 20 communicates with the ink introduction needle 21 through the filter 22, and the downstream side of the ink introduction path 20 communicates with the head flow path 25 (described later) formed inside the head main body 19. The inner diameter of the upstream side of the ink introduction path 20 is gradually enlarged from the downstream side to the upstream side. The filter 22 is attached in a state of blocking the opening of the enlarged portion. The filter 22 is a member that filters ink supplied from the ink cartridge 13 to the nozzle 17 of the head main body 19. For example, a metallic knitted mesh, a thin metal plate with many holes, or the like is used for the filter 21. The filter 22 catches foreign substances and bubbles in the ink. In this regard, in the present embodiment, an ink flow path from the ink cartridge 13 to the nozzle 17 through the ink introduction needle 21, the ink introduction path 20, and the head flow path 25 corresponds to the liquid flow path in the invention.

The ink introduction needle 21 is a needle-like hollow member using its internal space as a needle flow path 23, and is made of a synthetic resin, or the like, for example. The tip part of the ink introduction needle 21 is provided with an ink introduction hole 26 communicating with the needle flow path 23. When the ink introduction needle 21 is inserted into the ink cartridge 13, the ink in the cartridge 13 is introduced into the needle flow path 23 through the ink introduction hole 26. The inner diameter of the downstream side (ink introducing unit 18 side) from a substantially central part of the needle flow path 23 in the ink flow direction is enlarged from the upstream side (ink introduction hole 26 side) to the downstream side. The part having the enlarged inner diameter also functions as a filter chamber.

The head main body 19 includes a head flow path 25 and a piezoelectric element 11 as an actuator that causes ink in the head flow path 25 to produce pressure variations, and the like. The base (the opposite side to the recording medium S during recording processing) of the head main body 19 is provided with the nozzle 17. In the present embodiment, a plurality of the nozzles 17 are formed in a line at a pitch corresponding to the dot formation density in the transport direction (the vertical direction in FIG. 3) of the recording medium S in order to form a nozzle line. The head flow path 25 includes pressure chambers 28 individually communicating with respective ones of the nozzles 17, a common liquid chamber 27 that is common to the pressure chambers 28, and supply portions 29 that enable the common liquid chamber 27 to communicate with the pressure chambers 28. The ink that has been introduced from the ink introduction needle 21 and that flows through the ink introduction path 20 is introduced to the common liquid chamber 27. A part of a wall surface that partitions the pressure chambers 28, specifically, the side away from the nozzles 17 is formed by a flexible surface 30. The piezoelectric element 11 is formed on the flexible surface 30. The piezoelectric element 11 is a so-called flexural vibration type piezoelectric element, which is formed by stacking a lower electrode made of metal, a piezoelectric body made of, such as a lead zirconate titanate, or the like, for example, and an upper electrode made of metal in order. When a drive signal is selectively applied to the piezoelectric element 11 from the drive signal generation circuit 5 side through a signal line not illustrated in FIG. 3, the piezoelectric element 11 changes its shape in accordance with a potential change of the drive signal. This change causes the ink in each of the pressure chambers 28 to produce a pressure variation. The pressure variation of the ink is controlled so that ink is discharged from the nozzle 17.

Figure 4:
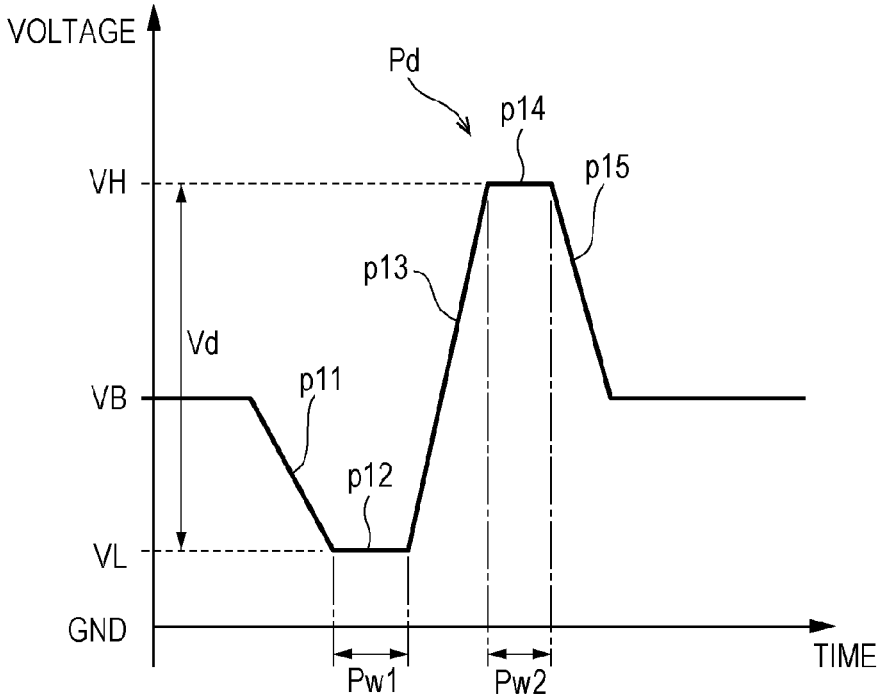
FIG. 4 is a waveform chart illustrating an example of a drive pulse.

FIG. 4 is a waveform chart illustrating an example of a drive pulse Pd generated by the drive signal generation circuit 5, which illustrates a basic waveform before correction is performed. In this regard, a description will be given later of the correction of the drive pulse Pd. The drive pulse Pd in the present embodiment includes an expansion element p11, an expansion hold element p12, a contraction element p13, a contraction hold element p14, and a return element p15. The expansion element p11 is a waveform element in which the potential changes from a reference potential VB to an expansion potential VL in the direction of the ground potential GND. The expansion hold element p12 is a waveform element that keeps the expansion potential VL, which is a terminal potential of the expansion element p11 for a certain time period. The contraction element p13 is a waveform element in which the potential changes in the direction of the plus side with a relatively steep slope from the expansion potential VL to a contraction potential VH beyond the reference potential VB. The contraction hold element p14 is a waveform element that keeps the contraction potential VH during a predetermined time period. The return element p15 is a waveform element in which the potential returns from the contraction potential VH to the reference potential VB.

When the drive pulse Pd formed as described above is applied to the piezoelectric element 11, first, the expansion element p11 causes the piezoelectric element 11 and the flexible surface 30 to bend to the outside (the side away from the nozzle 17 side) of the pressure chamber 28. In accordance with this, the pressure chamber 28 expands from the reference volume corresponding to the reference potential VB to the expansion volume corresponding to the expansion potential VL. This expansion causes the ink meniscus of the nozzle 17 to be pulled in from the standby position (the meniscus position when the pressure chamber 28 is maintained at the reference volume) to the pressure chamber 28 side along the axial direction of the nozzle 17. The expansion state of the pressure chamber 28 is maintained for a certain time period by the expansion hold element p12. After the holding by the expansion hold element p12, the contraction element p13 causes the piezoelectric element 11 and the flexible surface 30 to bend toward the inside of the pressure chamber 28 (toward the nozzle 17 side). Following this, the pressure chamber 28 is caused to abruptly contract from the expansion volume to the contraction volume corresponding to the contraction potential VH. Thereby, pressure is applied on the ink in the pressure chamber 28, the meniscus drawn in the pressure chamber 28 side is pushed out to the discharge side opposite to the pressure chamber 28 side along the axial direction of the nozzle 17 over the standby position. Thereby, an ink drop is discharged from the nozzle 17. The contraction state of the pressure chamber 28 is maintained over the supply period of the contraction hold element p14. Thus the ink pressure in the pressure chamber 28, which has decreased by the discharge of the ink during this period, increases again by the pressure vibration. The time period of the contraction hold element p14 is adjusted such that the return element p15 is applied to the piezoelectric element 11 so as to match the rise timing. Application of the return element p15 causes the piezoelectric element 11 to return to the steady state position corresponding to the reference potential VB. Following this, the pressure chamber 28 expands back to the steady state volume, and the pressure vibration (residual vibration) of the ink in the pressure chamber 28 is absorbed.

Concerning the drive pulse Pd (basic pulse), the drive voltage Vd (the potential difference between the expansion potential VL and the contraction potential VH) is set such that the amount of ink discharged from the nozzle 17 becomes a certain value, that is, a design target value. Also, the time period from the termination of the expansion element p11 to the beginning of the contraction element p13 (the time period of the expansion hold element p12) Pw1, and the time period from the termination of the contraction element p13 to the beginning of the return element p15 (the time period of the contraction hold element p14) Pw2are determined on the basis of the Helmholtz period (the natural vibration period of the ink) Tc of the pressure vibration of the ink in the pressure chamber 28. In general, it is possible to express the natural vibration period Tc by the following expression (1).

$$Tc=2\pi\sqrt{\{Cc/[(1/Mn)+(1/Ms)]\}} \quad \ldots \quad (1)$$

In the expression (1), Mn is the inertance (the mass of ink per unit cross-sectional area: [ink density ρ×flow path length L]/flow path cross-sectional area S) of the nozzle 17, Ms is the inertance of the supply portion 29, and Cc is the compliance (volume change per unit pressure, which indicates the degree of softness) of the pressure chamber 28. Thereby, it is possible to suitably perform discharging of ink in accordance with the pressure vibration that occurs with the ink in the pressure chamber 28 or the vibration control of the residual vibration after the discharging.

Incidentally, in the printer 1 in the present embodiment, the ink supplied from the ink cartridge 13 to each of the nozzles 17 of the head main body 19 through the ink introduction unit 18 is filtered in the middle by the filter 22. Accordingly, foreign substances, bubbles, and the like that are filtered out from the ink accumulate gradually on the filter 22. If the filter 22 is clogged with the accumulated foreign substances, ink supply is hindered, and thus the discharge characteristic of ink at the nozzle 17 might be affected. Specifically, if clogging of the filter 22 occurs, the above-described natural vibration period Tc tends to become longer. That is, if clogging of the filter 22 occurs, the flow path area of the filter 22 becomes small. Thereby, the same effect as that of increasing the inertance Ms of the supply portion 29 occurs. As a result, Tc becomes longer. Thus, in the printer 1 according to the invention, the state (the degree of clogging) of the filter 22 is determined using the detection value by the vibration detection circuit 6.

Figure 5:
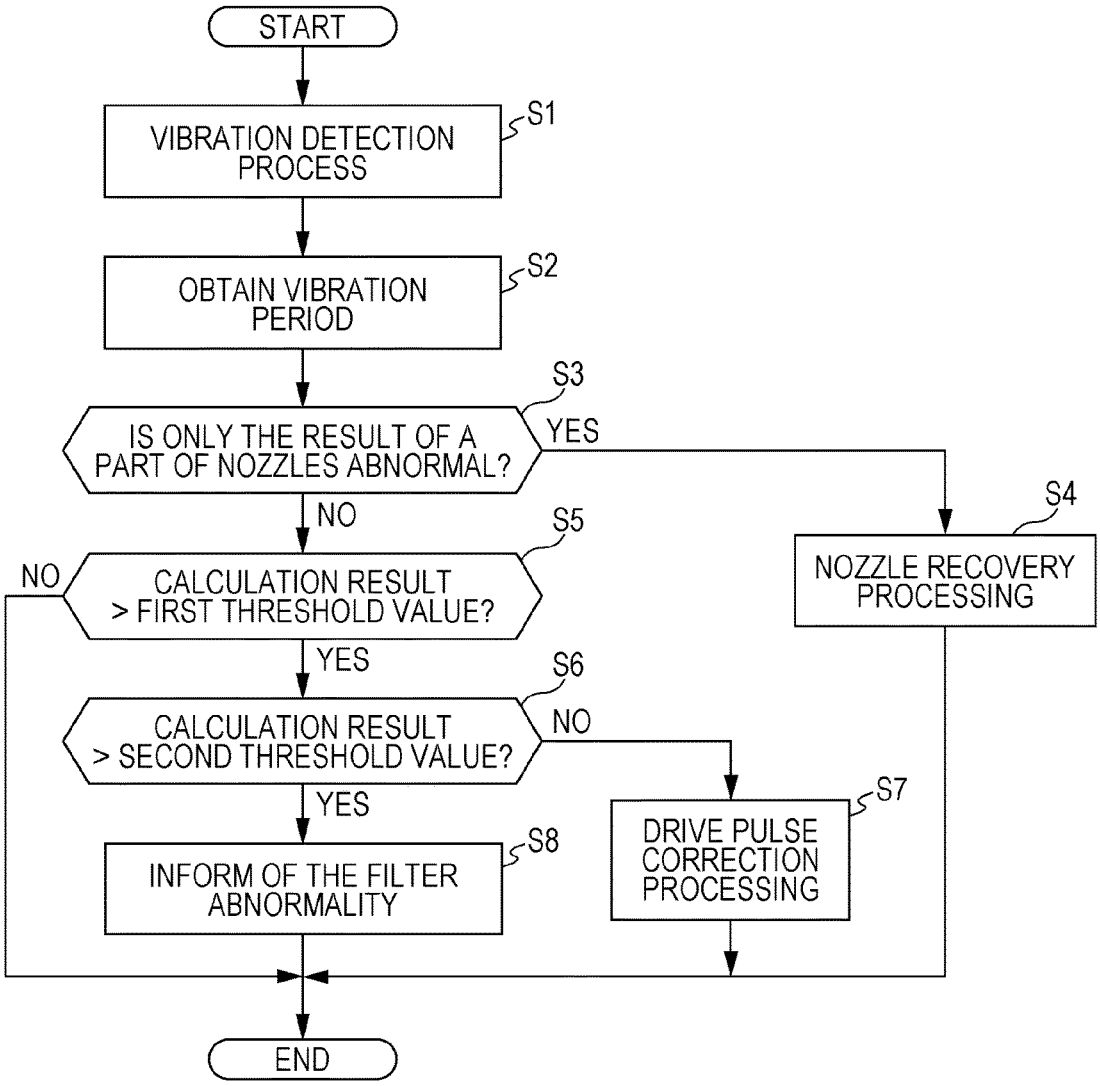
FIG. 5 is a flowchart illustrating processing for determining a state of a filter.

FIG. 5 is a flowchart illustrating processing for determining a state of a filter in the printer 1 according to the invention. In the present embodiment, the filter state determination processing is executed at certain intervals or when an instruction is given from a user through a printer driver, or the like. First, a vibration detection process is executed (step S1). In the vibration detection process, a drive pulse for detection is applied to a piezoelectric element 11 corresponding to the nozzle 17 to be detected in order to drive the piezoelectric element 11. When the piezoelectric element 11 is driven, a pressure vibration occurs in the ink inside (a part of the ink flow path) the pressure chamber 28 corresponding to the piezoelectric element 11. Following the damped vibration (residual vibration) of the pressure vibration, the flexible surface 30 and the piezoelectric element 11 of the pressure chamber 28 also vibrate. This vibration causes the piezoelectric element 11 to produce a counter electromotive force. The vibration detection circuit 6 detects this, and outputs a counter electromotive force signal to the CPU 2. In this regard, a method of detecting a pressure vibration of ink using a counter electromotive force signal of a piezoelectric element is well known and therefore the detailed description thereof will be omitted. The CPU 2 then obtains the vibration period of the ink in the pressure chamber 28 corresponding to the nozzle 17 to be detected on the basis of the counter electromotive force signal from the vibration detection circuit 6 as a detection value (step S2). In the present embodiment, the vibration detection process is executed for n pieces of ($1<n\leq m$) nozzles 17 out of all the nozzles 17 (m pieces) in the recording head 9 in sequence, and the vibration periods of the individual nozzles 17 are obtained. In this regard, in order to increase the determination precision of the filter state, it is desirable to obtain the vibration periods of all the (m pieces of) nozzles 17 in the recording head 9.

Here, concerning the detection value (vibration period) of the vibration detection process, threshold values are set in advance. In the present embodiment, two kinds of threshold values, namely a first threshold value and a second threshold value higher than the first threshold value are determined. The first threshold value is set to a value corresponding to the vibration period from which the impact on the discharge caused by the clogging of the filter 22 is considered to start, for example. Also, the second threshold value is set to a value corresponding to the vibration period at which the clogging is considered to have progressed to a degree that replacement of the filter 22 is required, for example.

When the detection values of the individual nozzles 17 are obtained, a determination is made of whether only a result of a part of the nozzles 17 is abnormal out of n pieces of the nozzles 17 (step S3). For example, the CPU 2 calculates n pieces of the obtained detection values. Specifically, the CPU 2 calculates the average value, and compares the average value with the detection value of each of the nozzles 17. A nozzle 17 having a detection value that is significantly different (higher) from the average value is determined to be abnormal. In this regard, it is possible to set the difference between the average value and a detection value, which is used as a criterion of the determination, to any value. Also, for a method of determination, for example, when the above-described average value is lower than or equal to the first threshold value, it is possible to employ a method of determining a nozzle 17 having a detection value higher than the first threshold value to be abnormal. In the same manner, when the above-described average value is higher than the first threshold value and lower or equal to the second threshold value, it is also possible to determine a nozzle 17 having a detection value higher than the second threshold value to be abnormal.

If determined that only the detection value of a part of the nozzles 17 is abnormal (Yes in step S3), a determination is made that a discharge failure has occurred in the nozzle 17 by a factor other than clogging of the filter 22, and nozzle recovery processing is executed (step S4). Specifically, well-known recovery processing, such as so-called flushing processing, in which ink is compulsorily discharged from the nozzle 17, or the like is executed. In this manner, even if a discharge failure occurs due to a factor other than the clogging of the filter 22, it is possible to perform suitable processing in accordance with this situation.

In the nozzle recovery processing, it is possible to change the intensity of the nozzle recovery processing, or the like for the case where the detection value of the corresponding nozzle 17 is between the first threshold value and the second threshold value, and for the case where the detection value is equal to or higher than the second threshold value. That is, when performing flushing processing as the nozzle recovery processing, it is possible to increase the intensity of the flushing processing in the case where the detection value is equal to or higher than the second threshold value than the intensity (for example, the amount of discharge per one time, the total number of discharge times, or the like) of the flushing processing in the case where the detection value is between the first threshold value and the second threshold value. Accordingly, it is possible to perform recovery processing that is more suitable for the state of the corresponding nozzle 17. In this manner, even if a discharge failure has occurred due to a factor other than clogging of a filter, it is possible to perform suitable processing, for example, performing maintenance processing, such as so-called flushing processing, or the like on the nozzle 17 in accordance with this situation.

In step S3, if not determined that only the detection value of a part of the nozzles 17 is abnormal, that is, if determined that the individual detection values of the n pieces of the nozzles 17 to be detected are substantially equal (No in step S3), next a determination is made of whether or not the result of the calculation of each detection value of the n pieces of nozzles 17 is equal to or higher than the first threshold value (step S5). Specifically, the CPU 2 calculates the average value of the individual detection values of the n pieces of nozzles 17 to be detected, and compares the result of the calculation with the first threshold value. Also, the result of the calculation is not limited to the average value of the individual detection values, and it is possible to use the sum total of the individual detection values. In this case, a threshold value in accordance with the sum total is set. If the result of the calculation is determined to be less than the first threshold value (No in step S5), a determination is made that there are no abnormal filters 22, and the processing is terminated. In this regard, in this case, the information that there are no abnormal filters 22 may be given through the display device 12 disposed on the printer 1, the printer driver to be executed on an external device connected to the printer 1, or the like.

On the other hand, if determined that the result of the calculation is equal to or higher than the first threshold value (Yes in step S5), next a determination is made of whether the result of the calculation is equal to or higher than the second threshold value (step S6). If determined that the result of the calculation is higher than the first threshold value and lower than or equal to the second threshold value (No in step S6), a determination is made that although relatively slight, the discharge characteristic of ink has been affected by clogging of the filter 22, and next, correction processing of the drive pulse is performed (Step S7).

Figure 6:
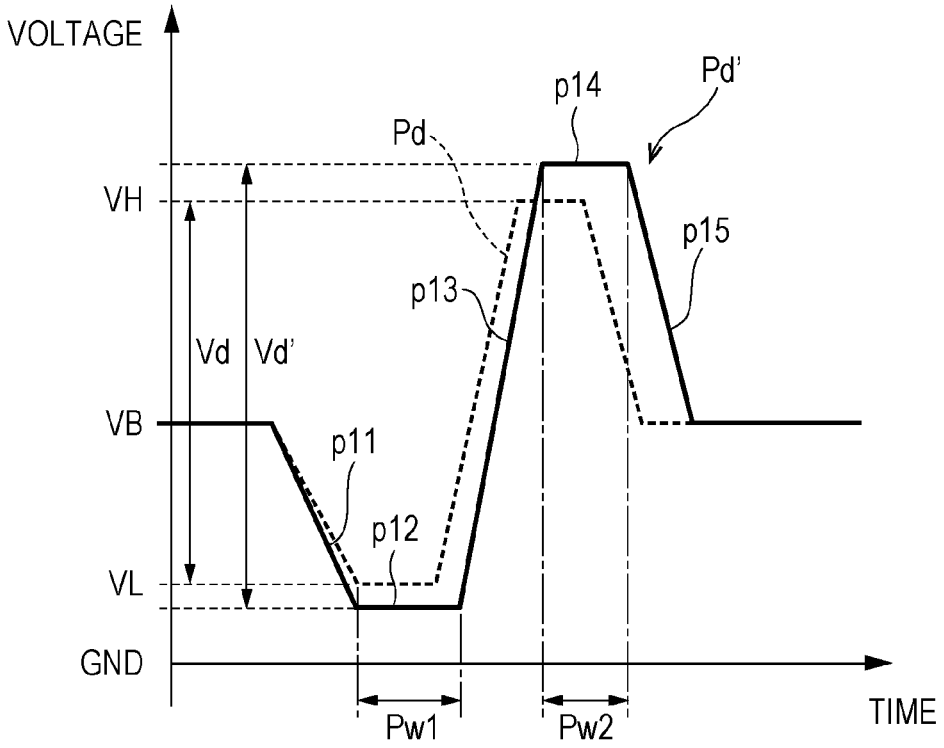
FIG. 6 is a waveform chart illustrating correction of the drive pulse.

FIG. 6 is a waveform chart illustrating correction of the drive pulse. In this regard, in FIG. 6, a waveform illustrated by a broken line is a drive pulse Pd (basic pulse) before the correction, and a waveform illustrated by a solid line is a drive pulse Pd' after the correction. As described above, if the filter 22 is clogged, the natural vibration period To becomes long. When the natural vibration period To becomes long, the discharge timing by the contraction element p13 and the vibration control timing by the return element p15 deviate in the drive pulse Pd. In the correction processing in the present embodiment, correction is performed for changing the expansion hold element p12 time Pw1 and the contraction hold element p14 time Pw2 in the drive pulse Pd by the amount of the change in the natural vibration period Tc. That is, correction is performed such that if the natural vibration period Tc becomes longer than the reference value (the initial value of Tc in the case where clogging has not occurred in the filter), Pw1 and Pw2 becomes longer by the same amount than those of the case of the reference pulse. Thereby, the discharge timing by the contraction element p13 and the vibration control timing by the return element p15 are suitably adjusted. It is therefore possible to suppress the situation in which the amount of ink drop discharged from the nozzle 17 and the discharging speed become unstable because of the change of the natural vibration period Tc. Also, the pressure loss of the filter 22 increases by the clogging, and the amount of ink drop discharged from the nozzle 17 decreases with this increase. Accordingly, correction for further increasing the drive voltage is performed. That is, a drive voltage Vd' higher than the drive voltage Vd of the reference pulse is set. Thereby, the amount of ink discharged from the nozzle 17 is made equal to the design target value.

In this manner, the drive pulse Pd is corrected when the detection value becomes higher than the first threshold value and lower than or equal to the second threshold value so that it is possible to continuously use the filter 22 up to the sate that requires replacement of the filter 22 while suppressing the adverse effect of the clogging of the filter 22 on the discharge characteristic. Accordingly, it is possible to maintain the recording image quality (recording quality) until replacement of the filter 22.

On the other hand, in step S6, if the result of the calculation is determined to be higher than the second threshold value (Yes in step S6), the state is recognized that the clogging has progressed to the extent that requires replacement of the filter 22. In this case, in step S8, the CPU 2 causes the display device 12 to display information on the clogging of the filter 22, or the like, for example so as to inform the user of abnormality of the filter 22 in order to prompt the user to perform maintenance, such as replacement or cleaning of the filter 22, or the like. Also, in order to prevent a discharge failure due to clogging of the filter 22, it is possible to regulate the processing so as to disable printing processing (recording processing) of the printer 1 until the maintenance of the filter 22 is complete. Thereby, it becomes possible to prevent deterioration of the recording image quality (recording quality) caused by clogging of the filter 22 in advance.

As described above, it is possible to detect vibration of the ink in the pressure chamber 28 by a counter electromotive force of the piezoelectric element 11 as a sensor, and to determine the state of the filter, that is, the degree of clogging using the detection result (vibration period). Thereby, it is possible to determine the state of the filter with an easier configuration without separately providing a special part or a structure in order to detect abnormality of the filter. Accordingly, higher versatility is obtained than related art. Also, the state of the filter 22 is determined by the comparison between the result of the calculation and a predetermined threshold value, and thus it is possible to promptly make a determination. Further, if the detection value becomes higher than the threshold value, the drive pulse Pd is corrected so that it becomes possible to make the amount of ink drop discharged from the nozzle 17 and the discharging speed close to the design target values. Accordingly, it is possible to suppress a decrease in the recording image quality due to clogging of the filter 22. If the result of the calculation becomes higher than the second threshold value, a determination is made that it has become the state requiring maintenance of the filter. Accordingly, it becomes possible to suitably handle the situation, such as informing the user of the timing of the maintenance, such as replacement or cleaning of the filter 22, or the like.

In this regard, the correction of the drive pulse when the detection value becomes equal to or higher than the first threshold value and less than the second threshold value is not limited to the illustrated example. If it is possible to recover a change of the discharge characteristic caused by clogging of the filter, various well-known methods may be employed. Also, the drive pulse Pd is not limited to the example illustrated in FIG. 4, and it is possible to employ various well-known drive pulses.

Also, in the above-described embodiment, the example of the configuration in which the filter 22 is disposed inside the recording head 9, specifically, on the downstream side of the ink introduction needle 21 is illustrated. However, the position of the filter is not limited to the exemplified position. For example, in the configuration in which ink is supplied to a recording head from an ink cartridge through an ink supply tube, a filter is sometimes disposed outside the recording head. In such a configuration, it is possible to apply the invention. In the same manner, for example it is possible to apply the invention to the configuration in which a filter is disposed in the flow path in the head main body 19.

Further, in the above-described embodiment, a so-called flexural vibration type piezoelectric element 11 has been exemplified as an actuator. However, the invention is not limited to this. For example, it is possible to apply the invention to the case where an actuator capable of detecting vibration of liquid in a liquid flow path, such as a so-called longitudinal vibration type piezoelectric element, or the like is used.

The invention can be applied not only to the above-described printer 1. If an apparatus has a configuration in which a filter is disposed in the middle of a supply route (liquid flow path) of liquid discharged from the nozzle of the liquid discharge head, it is possible to apply the invention to various ink jet recording apparatuses, such as a plotter, a facsimile machine, a copy machine, and the like. Alternatively, it is also possible to apply the invention to a liquid droplet discharge apparatus, such as a textile printing apparatus for performing textile printing on cloth (material to be subjected to textile printing), which is one kind of a target to be impacted, by impacting ink from the liquid discharge head, or the like.

The entire disclosure of Japanese Patent Application No. 2015-133269, filed Jul. 2, 2015 is expressly incorporated by reference herein.

What is claimed is:

1. A liquid discharge apparatus comprising:

a liquid discharge head including a plurality of nozzles configured to discharge liquid, liquid flow paths communicating individually with respective nozzles, and actuators configured to cause pressure vibration to be generated in liquid in the respective liquid flow paths, the liquid discharge head being configured to discharge liquid from corresponding nozzles by driving the actuators;

a filter configured to filter the liquid;

a vibration detection mechanism configured to detect vibration of the liquid generated by the driving of the actuators in the liquid flow paths; and a calculation circuit configured to obtain a detection value obtained by the vibration detection mechanism and perform calculation by using the detection value, wherein the vibration detection mechanism detects vibration of n ($1<n\leq m$) nozzles out of m nozzles included in the liquid discharge head, and the calculation circuit determines a state of the filter on the basis of a result of the calculation performed by using the detection value obtained by the vibration detection mechanism.

2. The liquid discharge apparatus according to claim 1, wherein the calculation circuit determines the state of the filter by comparing the result of the calculation and a predetermined threshold value.

3. The liquid discharge apparatus according to claim 2, wherein if the result of the calculation is higher than the threshold value, the calculation circuit corrects a drive pulse driving the actuator.

4. The liquid discharge apparatus according to claim 3, wherein if the result of the calculation is higher than a first threshold value, and lower than or equal to a second threshold value higher than the first threshold value, the control circuit corrects the drive pulse.

5. The liquid discharge apparatus according to claim 4, wherein if the result of the calculation is higher than the second threshold value, the control circuit determines that the filter is in a state requiring maintenance.

6. The liquid discharge apparatus according to claim 1, wherein if the detection value of a part of the nozzles out of the n nozzles to be detected is higher than the detection values of the remaining nozzles, the control circuit determines that a discharge failure has occurred due to a factor other than abnormality of the corresponding filter.

7. A method of controlling a liquid discharge apparatus including a liquid discharge head including a plurality of nozzles configured to discharge liquid, liquid flow paths communicating individually with respective nozzles, and actuators configured to cause pressure vibration to be generated in liquid in the respective liquid flow paths, the liquid discharge head being configured to discharge liquid from corresponding nozzles by driving the actuators, a filter configured to filter the liquid, a vibration detection mechanism configured to detect vibration of the liquid generated by the driving of the actuators in the liquid flow paths, and a calculation circuit configured to obtain a detection value obtained by the vibration detection mechanism and perform calculation by using the detection value, the method comprising:

detecting vibration, by the vibration detection mechanism, of n ($1<n\leq m$) nozzles out of m nozzles included in the liquid discharge head; and determining a state of the filter on the basis of a result of the calculation performed by using the detection value obtained by the vibration detection mechanism.

* * * * *